US005638693A

United States Patent [19]

Baek

[11] Patent Number: 5,638,693

[45] Date of Patent: Jun. 17, 1997

[54] ROOM AIR CONDITIONER

[75] Inventor: Sang Kyun Baek, Palyong-Dong, Rep. of Korea

[73] Assignee: LG Electronics Inc., Seoul, Rep. of Korea

[21] Appl. No.: 619,974

[22] Filed: Mar. 20, 1996

[30] Foreign Application Priority Data

Mar. 20, 1995 [KR] Rep. of Korea ..... 95-5810

[51] Int. Cl.[6] ..... F25D 23/12; F25D 19/00

[52] U.S. Cl. ..... 62/262; 62/298; 62/285; 312/400

[58] Field of Search ..... 62/262, 298, 279, 62/285; 312/400

[56] References Cited

U.S. PATENT DOCUMENTS

| | | | |
|---|---|---|---|
| 3,756,039 | 9/1973 | Riello | 62/262 |
| 4,607,499 | 8/1986 | Bolton et al. | 62/262 |
| 5,222,374 | 6/1993 | Thompson et al. | 62/262 |
| 5,461,880 | 10/1995 | Bolton et al. | 62/298 |

FOREIGN PATENT DOCUMENTS

| | | | |
|---|---|---|---|
| 51236 | 4/1979 | Japan | 62/262 |

*Primary Examiner*—William Doerrler
*Attorney, Agent, or Firm*—Fish & Richardson P.C.

[57] ABSTRACT

A room air conditioner designed to provide convenience in assembly and improve productivity by improving the structure of a wall portion for guiding and expelling conditioned air to a room. In the air conditioner, the wall portion includes a lower isolation and upper isolation wall portion. The lower isolation wall portion is molded and formed to provide a base wall, a lower barrier wall, a scroll section, a lower evaporator cover wall, a condensate gutter and a lower control unit chamber. The upper isolation wall portion is molded and formed to provide an upper barrier wall, an upper evaporator cover wall, a brace, and an upper control unit chamber. The lower and upper isolation wall portions are assembled together by latching structures. During such assembly, the lower barrier wall and the lower evaporator cover wall mate with the upper barrier wall and the upper evaporator cover wall, respectively, to provide thermal isolation between a condenser part and an evaporator part and smooth circulation of the conditioned air.

4 Claims, 7 Drawing Sheets

ROOM AIR CONDITIONER

BACKGROUND OF THE INVENTION

1. Field of the Invention

The present invention relates generally to an air conditioner, and more particularly to a room air conditioner which is conveniently assembled and increases productivity by improving the structure of wall portions provided therein.

2. Description of the Prior Art

Generally, air conditioners are apparatuses for conditioning air in a house or an office with a properly adjusted indoor temperature and humidity agreeable to the human body. In practice, the air conditioner may be controlled to keep an indoor temperature of about 28° C. and an indoor humidity of about 65–75% during hot summer days, while keeping the indoor temperature of about 18° C. and the indoor humidity of about 55–70% during cold winter days.

In such an air conditioner, and especially in a room air conditioner, all the operative components thereof are assembled in one unit. Within the room air conditioner unit, the evaporator and the exhaust grill portions for expelling the conditioned air to a room are located toward the room, and the condenser part which produces a super-heat during its operation is extended out of the room so as to be cooled by outdoor air.

FIGS. 1 and 2 show the exterior appearance and the structure of a conventional room air conditioner. Referring to FIGS. 1 and 2, the conventional room air conditioner, to perform refrigerating cycles, comprises a compressor 1 for compressing refrigerant gas with a high pressure and a high temperature, a condenser 2 for gradually condensing the high temperature and high-pressure refrigerant gas transferred from the compressor 1 to a liquid phase by heat radiation, an expansion valve 3 for reducing the pressure of the liquid-phase refrigerant transferred from the condenser 2 to change the liquid-phase refrigerant to a low temperature refrigerant in liquid and gas phases, and an evaporator 4 for evaporating the low temperature liquid and gas phases with absorption of environmental heat, and transferring the evaporated refrigerant gas to the compressor 1.

The conventional room air conditioner further comprises a base pan 5 for supporting all of the operative components thereon, first and second wall portions 6 and 7 vertically mounted on the base pan 5 with predetermined intervals to separate the evaporator part from the condenser part, a driving motor 9 fixed to a motor mount 8 which is vertically assembled on the base pan 5, being located between the first and second wall portions 6 and 7, a blower 10 and a fan 11 fixed to both ends of a driving shaft 91 of the driving motor 9, a control unit 12 assembled on the first wall portion 6 for the control of the room temperature, a grill portion 13, assembled in front of the first wall portion 6, for drawing indoor air there through and expelling the conditioned air to a room, and a cabinet mounted on the base pan 5 to cover all the operative components mounted on the base pan 5.

The first wall portion 6 comprises a barrier 61 vertically assembled on the base pan 5 to separate and isolate the evaporator part from the condenser part, a scroll 62, assembled with the base pan 5 and the barrier 61, for guiding the circulation of the air drawn by the blower 10 and conditioned through the evaporator 4 to the room, and gathering condensate collected on the evaporator 4 for the drainage out of the unit, an evaporator cover 63, assembled with the scroll 62, for guiding the circulation of the conditioned air to the room in cooperation with the scroll 62 so that the conditioned air is expelled through the grill portion 13, a brace 64, assembled with the second wall portion 7 and the barrier 61, for providing support between the first and second wall portions 6 and 7 at predetermined intervals, and fixing members 65 assembled on the lower part of the scroll to fix a temperature sensor for sensing the temperature of the drawn indoor air.

The second wall portion 7 has a structure assembled on the base pan 5 to separate and isolate the condenser part from the evaporator part. The second wall portion 7 guides the outdoor air drawn by the fan 11 so that the drawn air passes through the condenser 2 and then is expelled to the room through an outlet port 141 of the cabinet 14.

However, the conventional room air conditioner has the drawbacks in that the first wall portion 6 is composed of a large number of parts such as the metal barrier 61, scroll 62, evaporator cover 63, brace 64, and fixing members 65, and these parts are separately prepared by press bending before assembly, and thus relatively high material and labor costs are involved during manufacture. Further, since a large number of parts of the first wall portion 6 must be assembled one-by-one on the base pan 5 by assembling screws, such assembly work will greatly reduce the productivity of the room air conditioner.

SUMMARY OF THE INVENTION

It is an object of the present invention to provide a room air conditioner which can provide convenience in an assembly and thus improve the productivity of the room air conditioner by constructing its wall portion so that the wall portion forms two upper and lower major components which cooperate to support and position all of the operative components of the air conditioner.

In accordance with the present invention, there is provided a room air conditioner including a base pan for supporting all of the operative components mounted thereon, first and second wall portions vertically mounted on the base pan 5 with predetermined intervals to define an evaporator part and a condenser part, a driving motor fixed to a motor mount assembled on the base pan and located between the first and second wall portions, a blower and a fan fixed to both ends of a shaft of the driving motor, a control unit assembled on the first wall portion for a user's control of a room temperature, a grill portion, assembled in front of the first wall portion, for drawing indoor air there-through and expelling the conditioned air to a room, and a cabinet mounted on the base pan to cover all the operative components mounted on the base pan, characterized in that the first wall portion comprises:

a lower isolation wall portion which is molded and formed to provide a base wall assembled on the base pan, a lower barrier wall vertically formed on the base wall to provide a thermal isolation between the evaporator part and the condenser part, a scroll section formed on the lower barrier wall to guide circulation of air drawn by the blower and then conditioned by the evaporator back to the room, a lower evaporator cover wall formed on the lower barrier wall to guide circulation of the conditioned air back to the room in cooperation with the scroll section, a condensate gutter formed on the base wall to gather condensate collected on the evaporator and to drain the gathered condensate out of the room air conditioner, and gathered condensate out of the room air conditioner, and a lower control unit chamber formed on the base wall for installation of the control unit therein; and an upper isolation wall portion which is molded and formed to provide an upper barrier wall mating with an upper part of the lower barrier wall of the lower isolation wall portion to provide thermal isolation between the evaporator part and the condenser part, an upper evaporator cover wall formed on the upper barrier wall to mate with the lower evaporator cover wall of the lower isolation wall portion to cooperate to guide the circulation of the conditioned air back to the room, a brace formed on the upper barrier wall to provide support between the first and second wall portions at predetermined intervals, and an upper control unit chamber formed on the upper barrier wall to mate with the lower control unit chamber of the lower isolation wall portion.

Preferably, the base pan is provided with assembling holes formed on a forward wall of the base pan, at least one supporting stop formed on each side wall of the base pan, and a fastening hole formed on the center of a bottom plate of the base pan.

The lower isolation wall portion is also provided with assembling projections formed on the base wall to fit into the assembling holes of the base pan during assembly, at least one stepped recess formed on both sides of the base wall to interfit with the supporting stop of the base pan to fasten the base wall and the base pan together, and a supporting bent portion formed on the base wall to be aligned and secured with the fastening hole of the base pan.

Preferably, the stepped recess has a slant guiding surface which provides an easy interlocking of the stepped recess with the supporting stop of the base pan, thereby providing convenience in the assembling work of the lower isolation wall portion and the base pan.

The lower isolation wall portion is also provided with an assembling groove laterally formed along an upper end of the lower barrier wall, and at least one assembling rod extending upwardly from the scroll section.

The upper isolation wall portion is also provided with an assembling protrusion extending downwardly therefrom to fit with the assembling groove of the lower isolation wall portion during assembly, a lower edge portion extending downwardly therefrom to mate with an upper edge portion of the lower isolation wall portion to define the scroll section, and at least one conical tube extending downwardly therefrom to interfit and be secured with the assembling rod of the lower isolation wall portion.

According to the present invention, the evaporator is so mounted on the first wall portion that a pair of "L"-shaped assembling angles provided on the evaporator fit into securing grooves and securing shoulders formed on the upper and lower evaporator cover walls of the upper and lower isolation wall portions, respectively, and the other pair of "L"-shaped assembling angles provided on the evaporator fit into securing shoulders formed on the upper and lower evaporator cover walls of the upper and lower isolation wall portions, respectively.

It is also preferable that the second wall portion is provided with assembling female holes formed on the upper part thereof, and the brace of the upper isolation wall portion is provided with elastic assembling male portions formed on the end part of the brace. The assembling male portions of the brace are elastically inserted and fit into the assembling female holes of the second wall portion to provide interconnection therebetween at predetermined intervals.

The control unit is installed in and secured with the upper and lower control unit chambers of the upper and lower isolation wall portions.

BRIEF DESCRIPTION OF THE DRAWINGS

The above object, other features and advantages of the present invention will become more apparent by describing the preferred embodiment thereof with reference to the accompanying drawings, in which.

DETAILED DESCRIPTION OF THE PREFERRED EMBODIMENT

Figure 1:
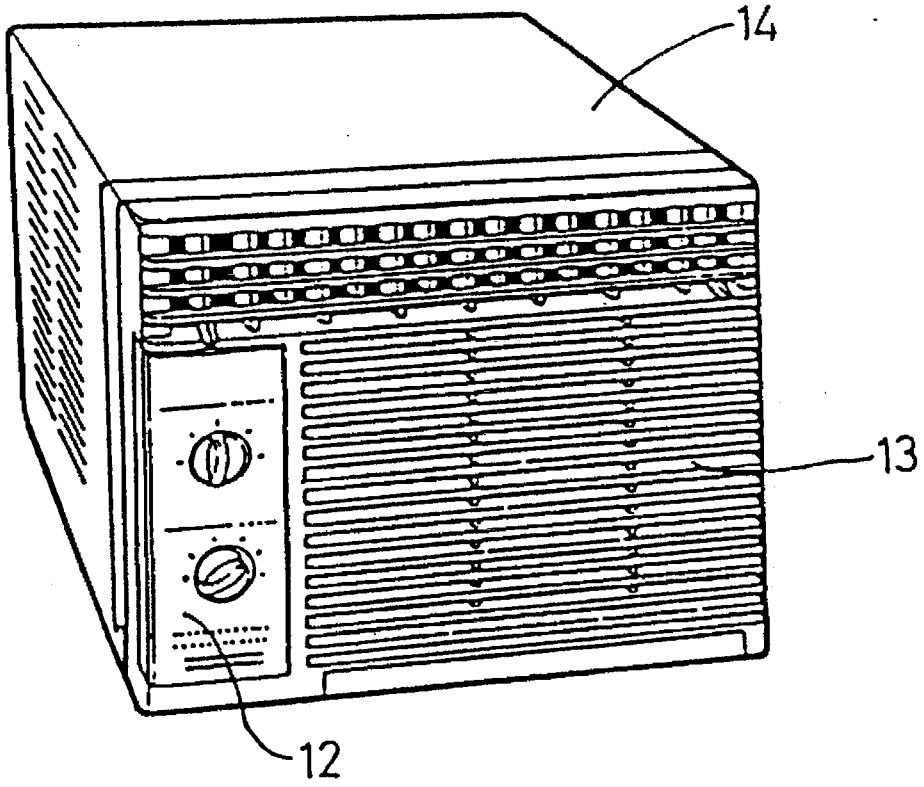
FIG. 1 (PRIOR ART)
FIG. 1 is a perspective view of a conventional room air conditioner.
Figure 2:
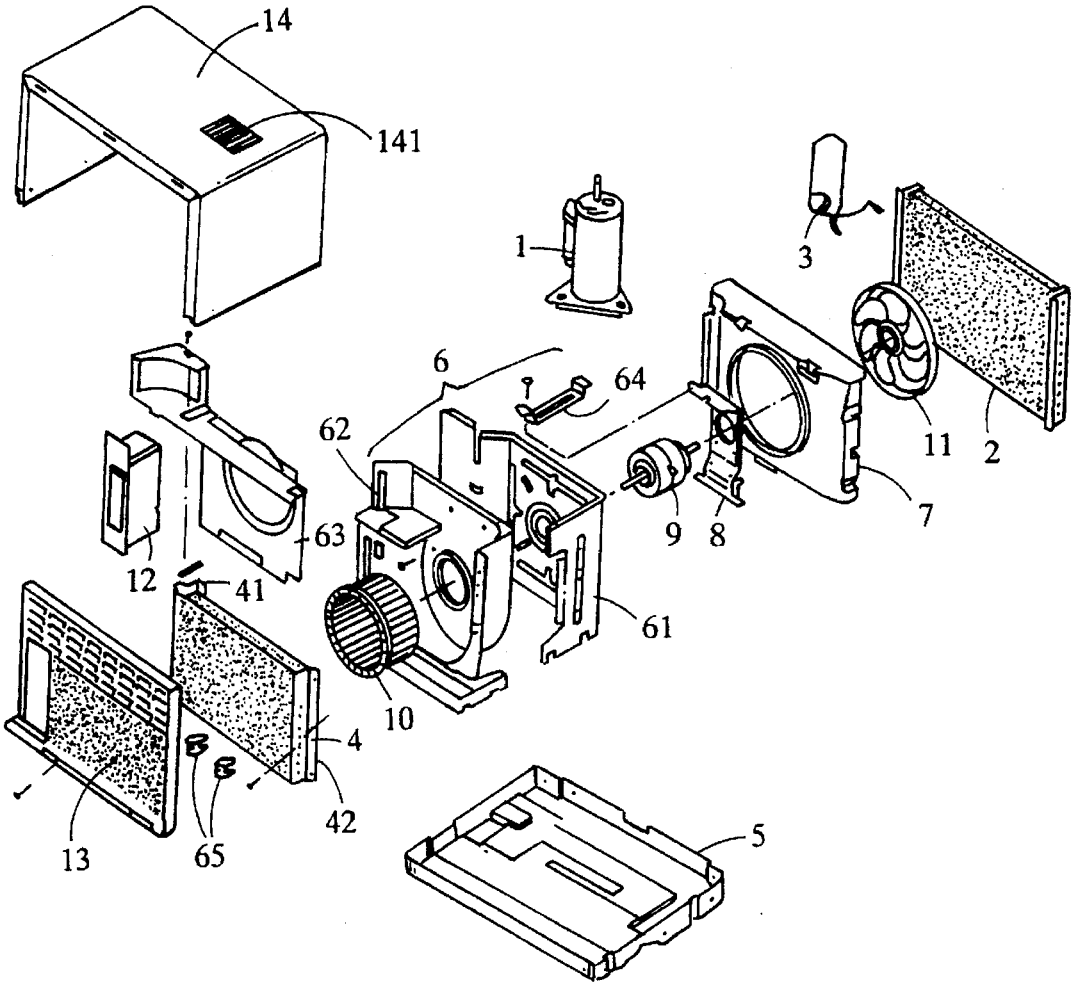
FIG. 2 (PRIOR ART)
FIG. 2 is an exploded perspective view of the conventional room air conditioner of FIG. 1.
Figure 3:
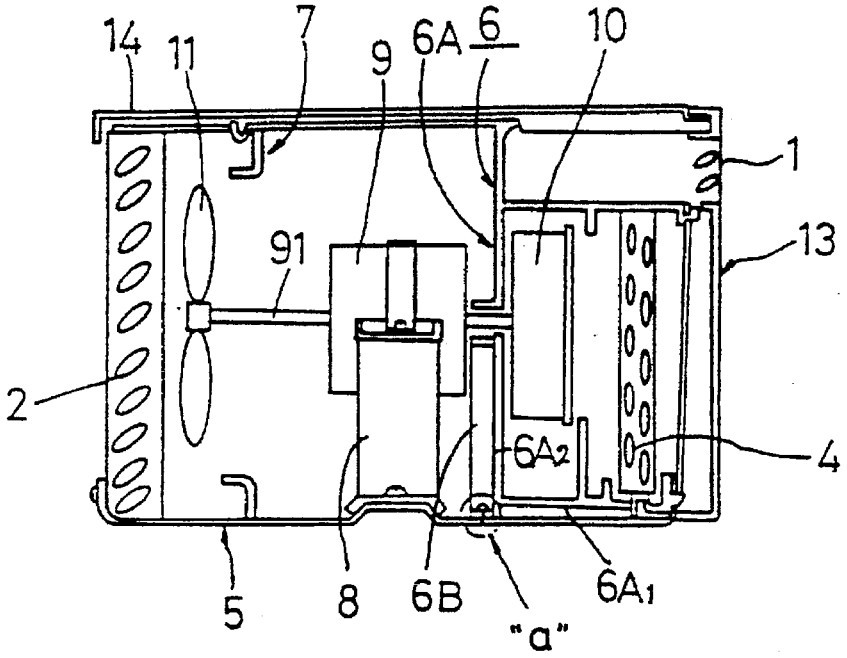
FIG. 3 is a side sectional view of the room air conditioner according to the present invention.
Figure 4:
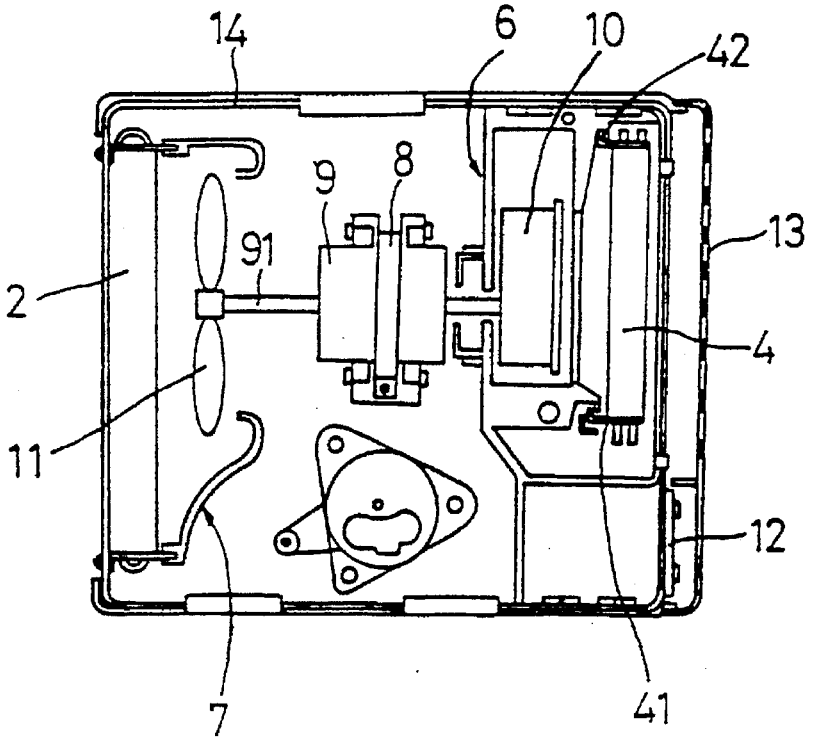
FIG. 4 is a plan sectional view of the room air conditioner according to the present invention.

FIG. 3 is a side sectional view of the room air conditioner according to the present invention. Referring to FIG. 3, the room air conditioner according to the present invention includes a base pan 5 for supporting a plurality of operative components mounted thereon, first and second wall portions 6 and 7 vertically mounted on the base pan 5 to define an evaporator 4 part and a condenser 2 part of the room air conditioner, a driving motor 9 fixed to a motor mount 8 assembled on the base pan 5 and located between the first and second wall portions 6 and 7, a blower 10 and a fan 11 fixed to both ends of a shaft 91 of the driving motor 9, a control unit 12 assembled on the first wall portion 6 for a user's control of a room temperature, a grill portion 13, assembled in front of the first wall portion 6, for drawing indoor air therethrough and expelling conditioned air to a room, and a cabinet 14 mounted on the base pan 5 to cover all the operative components mounted on the base pan 5.

The first wall portion 6 comprises a lower isolation wall portion 6A which is molded and formed to provide a base wall 6A1 assembled on the base pan 5, a lower barrier wall 6A2 vertically formed on the base wall 6A1 to provide a thermal insulation between the evaporator part and the condenser part, a scroll section 6A3, formed on the lower barrier wall 6A2, for guiding circulation of air inhaled by the blower 10 and then conditioned by the evaporator 4 back to the room, a lower evaporator cover wall 6A4, formed on the lower barrier wall 6A2, for guiding the circulation of the conditioned air back to the room in cooperation with the scroll section 6A3, a condensate gutter 6A5, formed on the base wall 6A1, for gathering condensate collected on the evaporator 4 and draining the gathered condensate out of the room air conditioner, a securing die 6A6, formed on the base wall 6A1, for securing a temperature sensor for sensing the temperature of the indoor air drawn by the blower 10, and a lower control unit chamber 6A7, formed on the base wall 6A1, for installing the control unit for the user's control of the room temperature.

The first wall portion 6 also comprises an upper isolation wall portion 6B which is molded and formed to provide an upper barrier wall 6B2 mating with an upper part of the lower barrier wall 6A2 to provide thermal insulation between the evaporator cover wall 6B3 formed on the upper barrier wall 6B2 to guide the circulation of the conditioned air back to the room, a brace 6B4 formed on the upper barrier wall 6B2 to provide support between the first and second wall portions 6 and 7 at predetermined intervals, and an upper control unit chamber 6B5 formed on the upper barrier wall 6B2 to mate with the lower control unit chamber 6B7.

Figure 5:
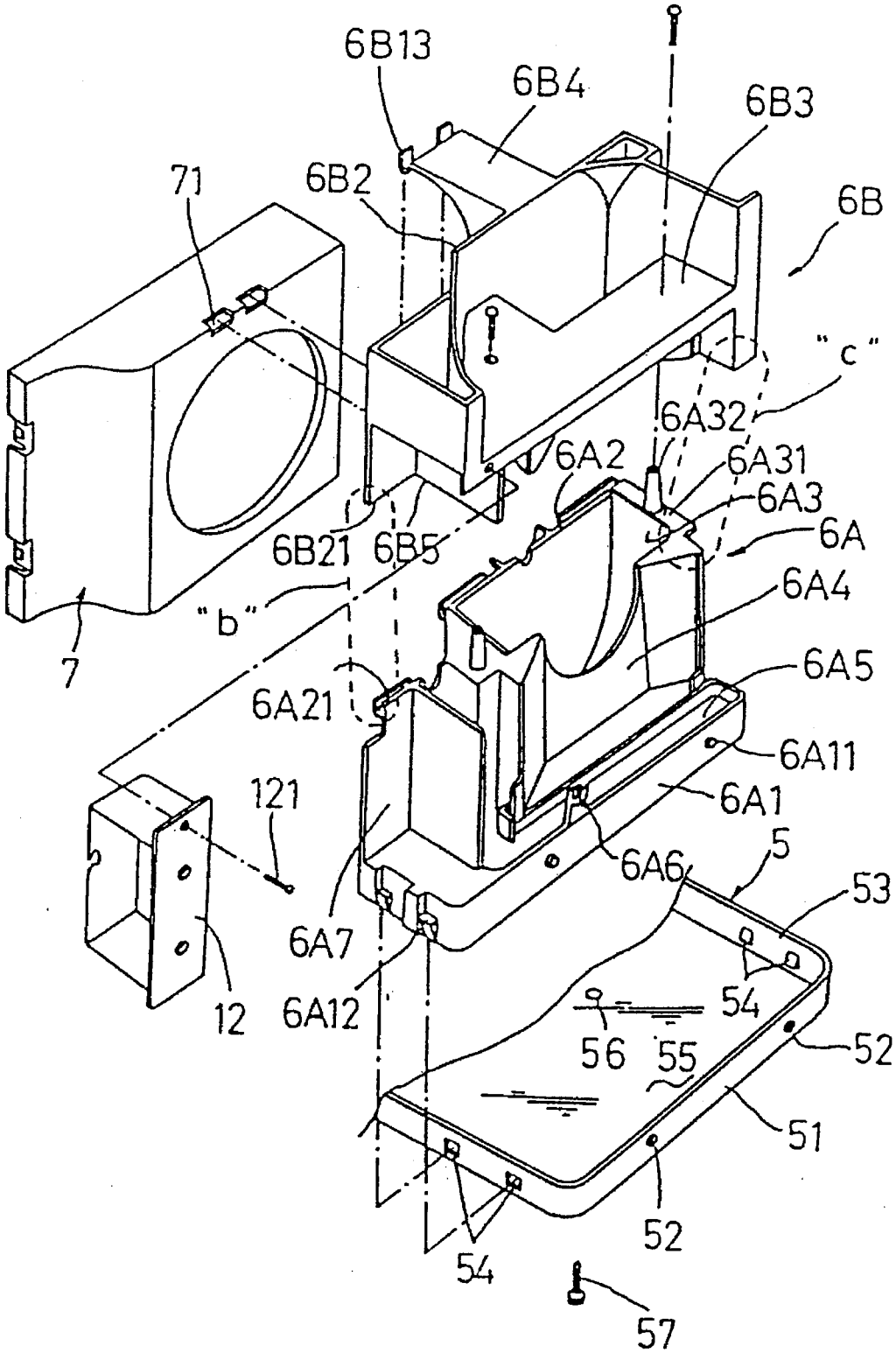
FIG. 5 is an exploded perspective view of the first wall portion, illustrating the structural details thereof.
Figure 6A:
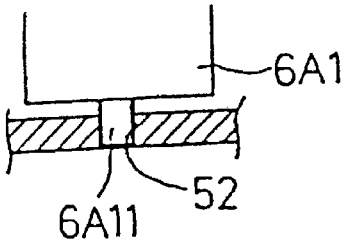
FIGS. 6A and 6B are enlarged, fragmentary side view illustrating the structure for mounting the base pan and the lower isolation wall section.
Figure 6B:
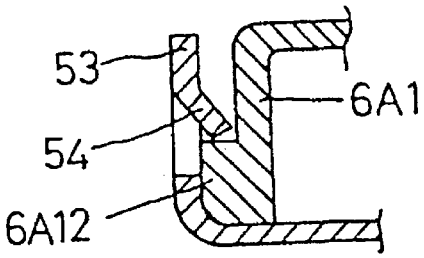

The base pan 5, as shown in FIGS. 5, 6A and 6B, is provided with assembling holes 52 formed on a forward wall 51 of the base pan 5, a pair of supporting stops 54 formed on side walls 53 of the base pan 5, and a fastening hole 56 formed on the center of a bottom plate 55 of the base pan 5.

The lower isolation wall portion 6A is provided with assembling projections 6A11 formed on the base wall 6A1 to fit into the assembling holes 52 during assembly, stepped recesses 6A12 formed on both sides of the base wall 6A1 to interfit with the pair of supporting stops 54, respectively, to fasten the base wall 6A1 and the base pan 5 together, and a supporting bent portion 6A13 formed on the base wall 6A1 to be aligned with the fastening hole 56 and secured by an assembling screw 57.

Figure 7:
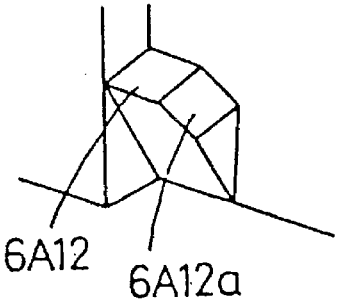
FIG. 7 is an enlarged, fragmentary perspective view of the stepped recess of the lower isolation wall section.
Figure 8:
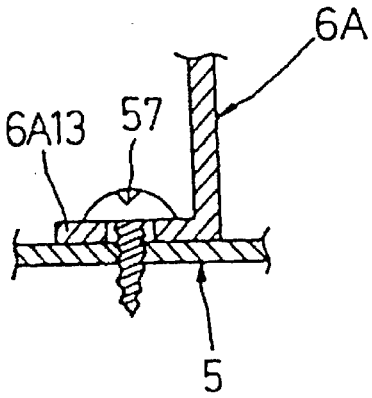
FIG. 8 is an enlarged, fragmentary sectional view illustrating the structure of "a" part in FIG. 3.
Figure 9:
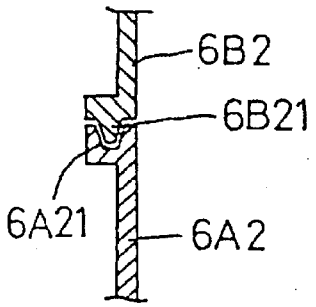
FIG. 9 is an enlarged, fragmentary sectional view illustrating the structure of "b" part in FIG. 5.
Figure 10:
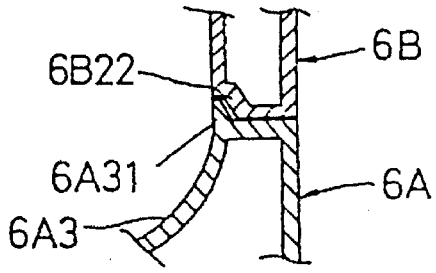
FIG. 10 is an enlarged, fragmentary sectional view illustrating the structure of "c" part in FIG. 5.
Figure 11:
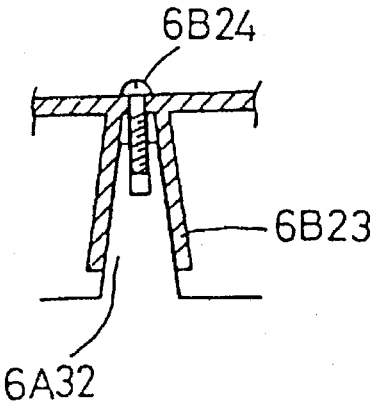
FIG. 11 is a sectional view illustrating the assembling rod and the conical tube in an assembled state.

The stepped recesses 6A12, as shown in FIG. 7, have slant guiding surfaces **6A12*a* which provide an easy interlocking of the stepped recesses 6A12 with the supporting stops 54**.

As shown in FIGS. 3, 8 to 10, the lower isolation wall portion 6A is also provided with an assembling groove 6A21 laterally formed along an upper end of the lower barrier wall 6A2, and assembling rods 6A32 extending upwardly from both sides of the scroll section 6A3.

The upper isolation wall portion 6B is provided with an assembling protrusion 6B21 extending downwardly from the upper barrier wall 6B2 to fit with the assembling groove 6A21 of the lower isolation wall portion 6A during assembly, a lower edge portion 6B22 extending downwardly from the upper isolation wall portion 6B to mate with an upper edge portion 6A31 of the lower isolation wall portion 6A and to define the scroll section 6A3, and conical tubes 6B23 extending downwardly from the upper isolation wall portion 6B to inter fit with the assembling rods 6A32 of the lower isolation wall portion A and to be secured by assembling screws 6B24.

Figure 12:
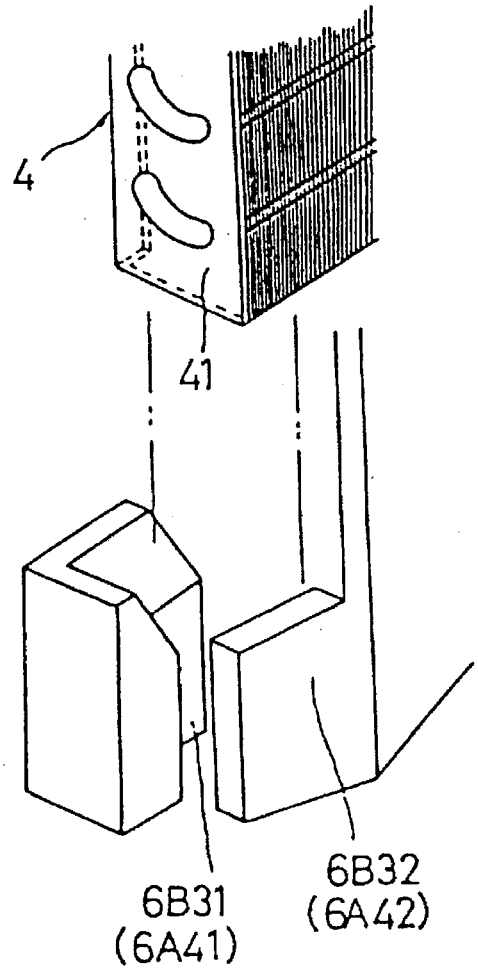
FIG. 12 is an exploded, fragmentary perspective view illustrating the assembled structure of the first and second isolation wall sections and the condenser in one direction.
Figure 13:
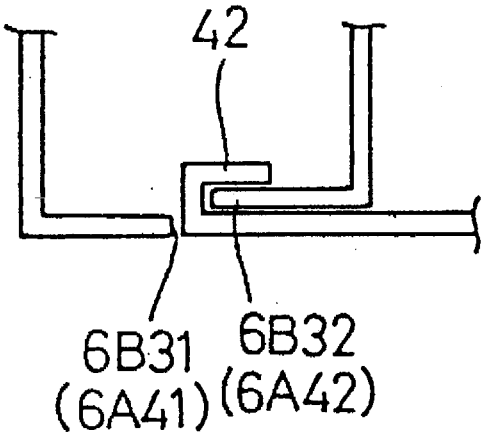
FIG. 13 is a fragmentary plan sectional view of the assembled structure of FIG. 12.
Figure 14:
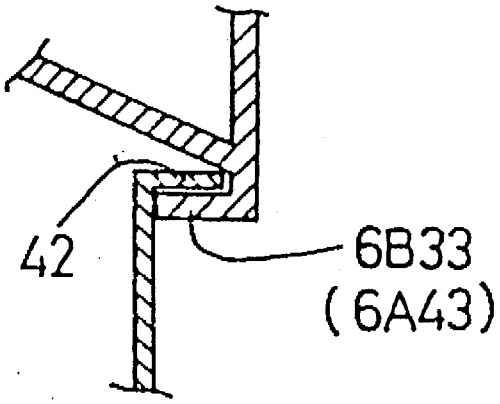
FIG. 14 is a fragmentary plan sectional view illustrating the assembled structure of the first and second isolation wall sections and the condenser in another direction.

As shown in FIGS. 12 to 14, the evaporator 4 is so mounted on the first wall portion 6 that one pair of "L"-shaped assembling angles 41 provided on the evaporator 4 fit into securing grooves 6B31 and 6A41 and securing shoulders 6A32 and 6A42 which are formed on the upper and lower evaporator cover walls 6B3 and 6B4 of the upper and lower isolation wall portions 6B and 6A, respectively, and the other pair of "L"-shaped assembling angles 42 provided on the evaporator 4 fit into securing shoulders 6B33 and 6A43 formed on the upper and lower evaporator cover walls 6B3 and 6A4, respectively.

The second wall portion 7 has assembling female holes 71 formed on the upper part thereof as shown in FIG. 5. The brace 6B4 formed on the upper isolation wall portion 6B is provided with elastic assembling male portions 6B13 formed on the end part of the brace 6B4 are elastically inserted and fit into the assembling female holes 71 of the second wall portion 7 to provide interconnection therebetween at predetermined intervals.

As shown in FIG. 5, the control unit 12 is installed in the upper and lower control unit chambers 6B5 and 6B7 of the upper and lower isolation wall portions 6B and 6A, and then is secured by an assembling screw 121.

In the preferred embodiment of the present invention, the upper and lower isolation wall portions 6B and 6A are molded as one-piece components. After all the operative components including the evaporator 4 are assembled on the lower isolation wall portions 6B and 6A are secured by latching structures.

In assembling the lower isolation wall portion 6A on the base pan 5, the base wall 6A1 of the lower isolation wall portion 6A is contacted with the base pan 5 and then pushed in a forward direction.

Accordingly, the stepped recesses 6A12 formed on the both sides of the base wall 6A1 are locked to and elastically interfit with the supporting stops 42 formed on the side walls 53 of the base pan 5. At this time, the assembling projections 6A11 formed on the base wall 6A1 of the lower isolation wall portion 6A are inserted into the assembling holes 52 formed on the forward wall 51 of the base pan 5, respectively. Also, the supporting bent portion 6A13 extending from the base wall 6A1 is aligned with the fastening hole 56 formed on the center of the bottom plate 55 of the base pan 5, and then secured by the screw 57 to complete the assembling work of the first wall portion 6.

The operative components are first assembled on the lower isolation wall portion 6A. The evaporator 4 is mounted within the evaporator chamber provided by the upper and lower isolation wall portions 6B and 6A.

Specifically, before the upper and lower isolation wall portions 6B and 6A are assembled, the lower end of the assembling angles 41 and 42 provided on the evaporator 4 are inserted and fit into the securing groove 6A41 and the securing shoulder 6A42 formed on the lower isolation wall portion 6A.

Thereafter, the upper isolation wall portion 6B is assembled on the upper part of the lower isolation wall portion 6A. During such assembly, the upper end of the assembling angles 41 and 42 of the evaporator 4 are inserted and fit into the securing groove 6B31, and the securing shoulders 6B32 and 6B33, respectively, which are formed on the upper isolation wall portion 6B, being opposite to the securing groove 6A41 and the securing shoulders 6A42 and 6A43, respectively.

When the upper isolation wall portion 6B is assembled on the upper part of the lower isolation wall portion 6A, the assembling protrusion 6B21 of the upper barrier wall 6B2 is inserted and fit into the assembling groove 6A21 laterally formed along the upper end of the lower barrier wall 6A2. At this time, the upper edge portion 6A31 of the lower isolation wall portion 6A mates with the lower edge portion 6B22 of the upper isolation wall portion 6B to provide thermal insulation and smooth circulation of the conditioned air. Also, the assembling rods 6A32 of the lower isolation wall portion 6A air are inserted and fit into the conical tubes 6B23 of the upper isolation wall portion 6B, and are secured by the assembling screws 6B24 to prevent the upper isolation wall portion 6B from releasing from the lower isolation wall portion 6A.

Thereafter, the assembling male portions 6B13 formed on the brace 6B4 of the upper isolation wall portion 6B are inserted and fit into the assembling female holes 71 formed on the second wall portion 7 to provide interconnection between the upper isolation wall portion 6B and the second wall portion 7 with predetermined intervals.

From the foregoing, it will be apparent that the room air conditioner according to the present invention is conveniently assembled, and increases productivity and lowers manufacturing cost by constructing the first wall portion of the room air conditioner with two molded major components which can be secured together by latching structures.

While the present invention has been described and illustrated herein with reference to the preferred embodiment thereof, it will be understood by those skilled in the art that various changes in form and details may be made therein without departing from the spirit of scope of the invention.

What is claimed is:

1. A room air conditioner including a base pan for supporting all operative components mounted thereon, first and second wall portions vertically mounted on the base pan with predetermined intervals to define an evaporator part and a condenser part, a driving motor fixed to a motor mount assembled on the base pan and located between the first and second wall portions, a blower and a fan fixed to both ends of a shaft of the driving motor, a control unit assembled on the first wall portion for a user's control of a room temperature, a grill portion, assembled in front of the first wall portion, for drawing indoor air therethrough and expelling the conditioned air to a room, and a cabinet mounted on the base pan to cover all the operative components mounted on the base pan, characterized in that the first wall portion comprises:

a lower isolation wall portion which is molded and formed to provide a base wall assembled on the base pan, a lower barrier wall vertically formed on the base wall to provide a thermal isolation between the evaporator part and the condenser part, a scroll section formed on the lower barrier wall to guide circulation of air drawn by the blower and then conditioned by the evaporator back to the room, a lower evaporator cover wall formed on the lower barrier wall to guide circulation of the conditioned air back to the room in cooperation with the scroll section, an assembling groove laterally formed along an upper end of the lower barrier wall, an upper edge portion formed along an upper end of the scroll section, and at least one assembling rod extending upwardly from the scroll section, a condensate gutter formed on the base wall to gather condensate collected on the evaporator and to drain the gathered condensate out of the room air conditioner, and a lower control unit chamber formed on the base wall for installation of the control unit therein; and an upper isolation wall portion which is molded and formed to provide an upper barrier wall mating with an upper part of the lower barrier wall of the lower isolation wall portion to provide thermal isolation between the evaporator part and the condenser part, an upper evaporator cover wall formed on the upper barrier wall to mate with the lower evaporator cover wall of the lower isolation wall portion to cooperate to guide the circulation of the conditioned air back to the room, a brace formed on the upper barrier wall to provide support between the first and second wall portions at predetermined intervals, an assembling protrusion extending downwardly from the upper barrier wall to fit into the assembling groove of the lower barrier wall, a lower edge portion formed along the lower end of the upper barrier wall to mate with the upper edge portion of the lower isolation wall portion to provide thermal insulation and smooth circulation of the conditioned air through the scroll section, and at least one conical tube formed downwardly on the upper barrier wall to interfit and be secured with the assembling rod of the lower isolation wall portion, and an upper control unit chamber formed on the upper barrier wall to mate with the lower control unit chamber of the lower isolation wall portion.

2. A room air conditioner including a base pan for supporting all operative components mounted thereon, first and second wall portions vertically mounted on the base pan with predetermined intervals to define an evaporator part and a condenser part, a driving motor fixed to a motor mount assembled on the base pan and located between the first and second wall portions, a blower and a fan fixed to both ends of a shaft of the driving motor, a control unit assembled on the first wall portion for a user's control of a room temperature, a grill portion, assembled in front of the first wall portion, for drawing indoor air therethrough and expelling the conditioned air to a room, and a cabinet mounted on the base pan to cover all the operative components mounted on the base pan, characterized in that the base pan comprises assembling holes formed on a forward wall thereof, at least one supporting stop formed on a side wall thereof, and a fastening hole formed on the center of a bottom plate thereof, and further characterized in that the first wall portion comprises:

a lower isolation wall portion which is molded and formed to provide a base wall assembled on the base pan, a lower barrier wall vertically formed on the base wall to provide a thermal isolation between the evaporator part and the condenser part, a scroll section formed on the lower barrier wall to guide circulation of air drawn by the blower and then conditioned by the evaporator back to the room, a lower evaporator cover wall formed on the lower barrier wall to guide circulation of the conditioned air back to the room in cooperation with the scroll section, a condensate gutter formed on the base wall to gather condensate collected on the evaporator and to drain the gathered condensate out of the room air conditioner, assembling projections formed on the base wall to fit into the assembling holes of the base pan during assembly, at least one stepped recess formed on both sides of the base wall to interfit with the supporting stop of the base pan to fasten the base wall and the base pan together, and a supporting bent portion formed on the base wall to be aligned and secured with the fastening hole of the base pan, and a lower control unit chamber formed on the base wall for installation of the control unit therein; and an upper isolation wall portion which is molded and formed to provide an upper barrier wall mating with an upper part of the lower barrier wall of the lower isolation wall portion to provide thermal isolation between the evaporator part and the condenser part, an upper evaporator cover wall formed on the upper barrier wall to mate with the lower evaporator cover wall of the lower isolation wall portion to cooperate to guide the circulation of the conditioned air back to the room, a brace formed on the upper barrier wall to provide support between the first and second wall portions at predetermined intervals, and an upper control unit chamber formed on the upper barrier wall to mate with the lower control unit chamber of the lower isolation wall portion.

3. A room air conditioner as claimed in claim 2, wherein the stepped recess of the lower isolation wall portion has a slant guiding surface to provide easy interlocking of the stepped recess with the supporting stop of the base pan.

4. A room air conditioner including a base pan for supporting all operative components mounted thereon, first and second wall portions vertically mounted on the base pan with predetermined intervals to define an evaporator part and a condenser part, a driving motor fixed to a motor mount assembled on the base pan and located between the first and second wall portions, a blower and a fan fixed to both ends of a shaft of the driving motor, a control unit assembled on the first wall portion for a user's control of a room temperature, a grill portion, assembled in front of the first wall portion, for drawing indoor air therethrough and expelling the conditioned air to a room, and a cabinet mounted on the base pan to cover all the operative components mounted on the base pan, characterized in that the evaporator has two pairs of assembling angles installed on both sides thereof, and further characterized in that the first wall portion comprises:

a lower isolation wall portion which is molded and formed to provide a base wall assembled on the base pan, a lower barrier wall vertically formed on the base wall to provide a thermal isolation between the evaporator part and the condenser part, a scroll section formed on the lower barrier wall to guide circulation of air drawn by the blower and then conditioned by the evaporator back to the room, a lower evaporator cover wall formed on the lower barrier wall to guide circulation of the conditioned air back to the room in cooperation with the scroll section, a condensate gutter formed on the base wall to gather condensate collected on the evaporator and to drain the gathered condensate out of the room air conditioner, and a lower control unit chamber formed on the base wall for installation of the control unit therein; and an upper isolation wall portion which is molded and formed to provide an upper barrier wall mating with an upper part of the lower barrier wall of the lower isolation wall portion to provide thermal isolation between the evaporator part and the condenser part, an upper evaporator cover wall formed on the upper barrier wall to mate with the lower evaporator cover wall of the lower isolation wall portion to cooperate to guide the circulation of the conditioned air back to the room, a brace formed on the upper barrier wall to provide support between the first and second wall portions at predetermined intervals, an upper control unit chamber formed on the upper barrier wall to mate with the lower control unit chamber of the lower isolation wall portion; and the upper and lower evaporator cover walls of the upper and lower isolation wall portions have securing grooves and securing shoulders respectively formed thereon so that said assembling angles are inserted and fit into the securing grooves and securing shoulders, respectively.

* * * * *